United States Patent [19]

Lewis

[11] Patent Number: 4,924,644

[45] Date of Patent: May 15, 1990

[54] CONSTRUCTION BOARD GRID SYSTEM WITH IMPRINT AND METHOD OF USING SAME

[76] Inventor: David L. Lewis, 36 Carol Dr., Cheshire, Conn. 06410

[21] Appl. No.: 189,808

[22] Filed: May 3, 1988

[51] Int. Cl.[5] ..... E04B 1/00

[52] U.S. Cl. ..... 52/105; 52/309.9; 52/746; 52/747

[58] Field of Search ..... 52/105, 309.9, 746, 52/747

[56] References Cited

U.S. PATENT DOCUMENTS

| | | | |
|---|---|---|---|
| 2,610,413 | 9/1952 | Dasey . | |
| 3,344,528 | 10/1967 | Purdum et al. . | |
| 3,363,369 | 1/1968 | Miller | 52/105 X |
| 3,835,604 | 9/1974 | Hoffmann, Jr. | 52/105 |
| 3,933,398 | 1/1976 | Haag | 52/631 X |
| 4,018,016 | 4/1977 | Zale | 52/200 X |
| 4,148,164 | 4/1979 | Humphrey | 52/105 X |
| 4,691,491 | 9/1987 | Lilley | 52/712 X |
| 4,743,485 | 5/1988 | Ting | 52/309.9 X |
| 4,776,139 | 10/1988 | Lockwood | 52/DIG. 10 X |

FOREIGN PATENT DOCUMENTS

| | | | |
|---|---|---|---|
| 2256096 | 5/1974 | Fed. Rep. of Germany | 52/105 |
| 489041 | 7/1938 | United Kingdom | 16/135 |
| 593975 | 10/1947 | United Kingdom | 16/135 |

*Primary Examiner*—Henry E. Raduazo
*Assistant Examiner*—Lan Mai

[57] ABSTRACT

An insulating panel for buildings has an insulating core with one face imprinted with a grid pattern and a multiplicity of rectilinear lines radiating from one corner and defining increasing included angles relative to the base side of the panel which corresponds to pitch lines of roofs. The pitch line of a roof may be determined, and then the equivalent angular line located on the printed face. The panel may be cut along this line to abut closely the structural member of the roof extending at that angle. Vertical and horizontal measurements of the space in which the panel is to be fitted can be readily transposed to the grid pattern for making perpendicular or horizontal cuts therealong. The panel is conveniently formed by imprinting a facing sheet member and securing it to a synthetic resin core member.

19 Claims, 4 Drawing Sheets

CONSTRUCTION BOARD GRID SYSTEM WITH IMPRINT AND METHOD OF USING SAME

BACKGROUND OF INVENTION

The present invention relates to insulating panels for buildings, and more particularly to such panels which may be readily cut to closely fit pitch lines of roofs and the like.

Insulating panels for buildings are generally of rectangular configuration and generally comprise an insulating body, most usually a cellular synthetic resin core, and may include facing sheets on both faces thereof. Metallic foil and plastic film such as aluminum are widely utilized for the facing sheets when the panels are to be disposed on the inside surface of the building. For exterior applications, paper or perforated synthetic resin film and foil are employed to provide the necessary permeability to moisture and air to permit the wall to breathe.

To fit the panels tightly over the surface of a wall underlying a roof or other pitched structural element, it is necessary to determine the angle or pitch of the structural member involved and then to use tools for translating the angle to the face of the panel so that it may be scribed and cut to fit against that structural member. Moreover, since the space in which a panel is to fit may be less than its full size even when it is a rectangular space, it is frequently necessary to measure the available space and then to measure the length of the width the panel so as to cut it along a line scribed thereon reflecting the appropriate dimensions. Frequently, the cuts which are made upon the panels are not straight and the dimensions are not accurately transferred.

It is an object of the present invention to provide a novel insulating panel which will permit facile cutting at angles corresponding to the pitch of roof lines or other inclined structural members.

It is also a object to provide such insulating panels which permit facile cutting, either horizontally or vertically, along straight lines without the need for measuring tools or for scribing straight lines thereon.

Another object is to provide such panels which may be readily and economically fabricated.

A further object is to provide novel methods for insulating buildings by use of such panels.

SUMMARY OF THE INVENTION

It has now been found that the foregoing and related objects may be readily attained in a building panel having an insulating member of generally rectangular configuration with a pair of generally planar faces and formed from a material providing insulating characteristics. At least one of the faces has printed thereon a grid pattern and a multiplicity of rectilinear lines extending from one corner of the panel at different angular relationships to the base side of the panel, and these rectilinear lines extend to the opposite sides of the panel. Desirably, the printed face is imprinted with a second multiplicity of rectilinear lines extending from the other corner along the base of the panel and these lines intersect the first mentioned multiplicity of lines. Indicia are imprinted adjacent the rectilinear lines to identify the angular relationships denoted thereby. In some panels, both faces may be imprinted with the grid pattern and multiplicity of lines.

Generally, the insulating member is formed by imprinting a first facing sheet member and adhering it to a synthetic resin core member. A second facing sheet member may be secured to the other face. The core member may desirably be formed from a synthetic resin of closed cell construction to provide optimum thermal insulating characteristics. The indicia are numerical indicia adjacent lines corresponding to the pitch of a roof line represented by the indicia, and the grid pattern is comprised of lines spaced apart at one inch intervals.

Preferably, at least one facing sheet member is a metallic foil adhesively bonded to the core member, and such foil may be perforated for exterior application.

In use of these panels for insulating buildings, the pitch of the roof is determined by inspection of blueprints, by measurement, or other suitable means. The line corresponding to the pitch is located on the printed facing member, and the insulating panel is cut along the located line. The cut panel is then mounted on the face of the building with the cut line abutting a structural element conforming to the pitch line.

In the same or subsequent fitting, the space transversely of the wall upon which the panel is to be mounted is measured to determine the width desired for the panel in this space. The vertical grid line corresponding to the desired width is found and the panel is cut along the vertical grid line. Similarly, the height of the panel may be cut to fit the vertical space by use of a horizontal grid line.

DETAILED DESCRIPTION OF THE ILLUSTRATED EMBODIMENT

Figure 1:
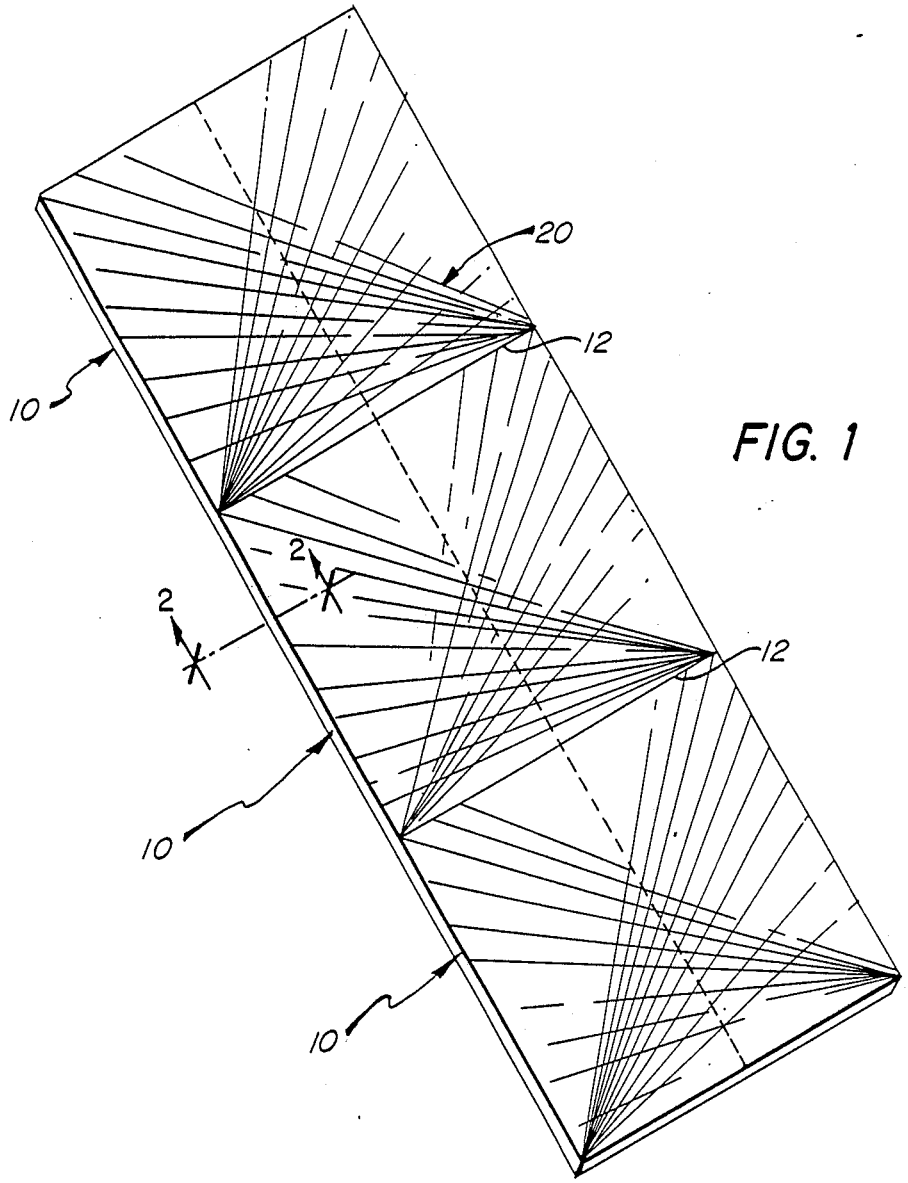
FIG. 1 is a perspective view of an unfolded length of fan-foldable insulating board embodying the present invention.
Figure 2:
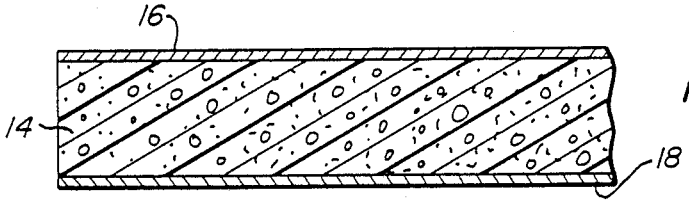
FIG. 2 is a fragmentary cross sectional view along the line 2—2 of FIG. 1 and drawn to an enlarged scale.

Turning first to FIG. 1, therein illustrated is a fan-foldable assembly of three insulating panels embodying the present invention and generally designated by the numeral 10 with spaced fold lines 12 therebetween. As seen in FIG. 2, the panels 10 comprise a core 14 of closed cell, foamed synthetic resin providing insulating properties, a first facing sheet member 16 on one face of the core 14, and a second facing sheet member 18 on the opposite face of the core 14. These facing sheet members 16, 18 are generally bonded to the core 14 by a layer of adhesive (not shown).

Figure 3:
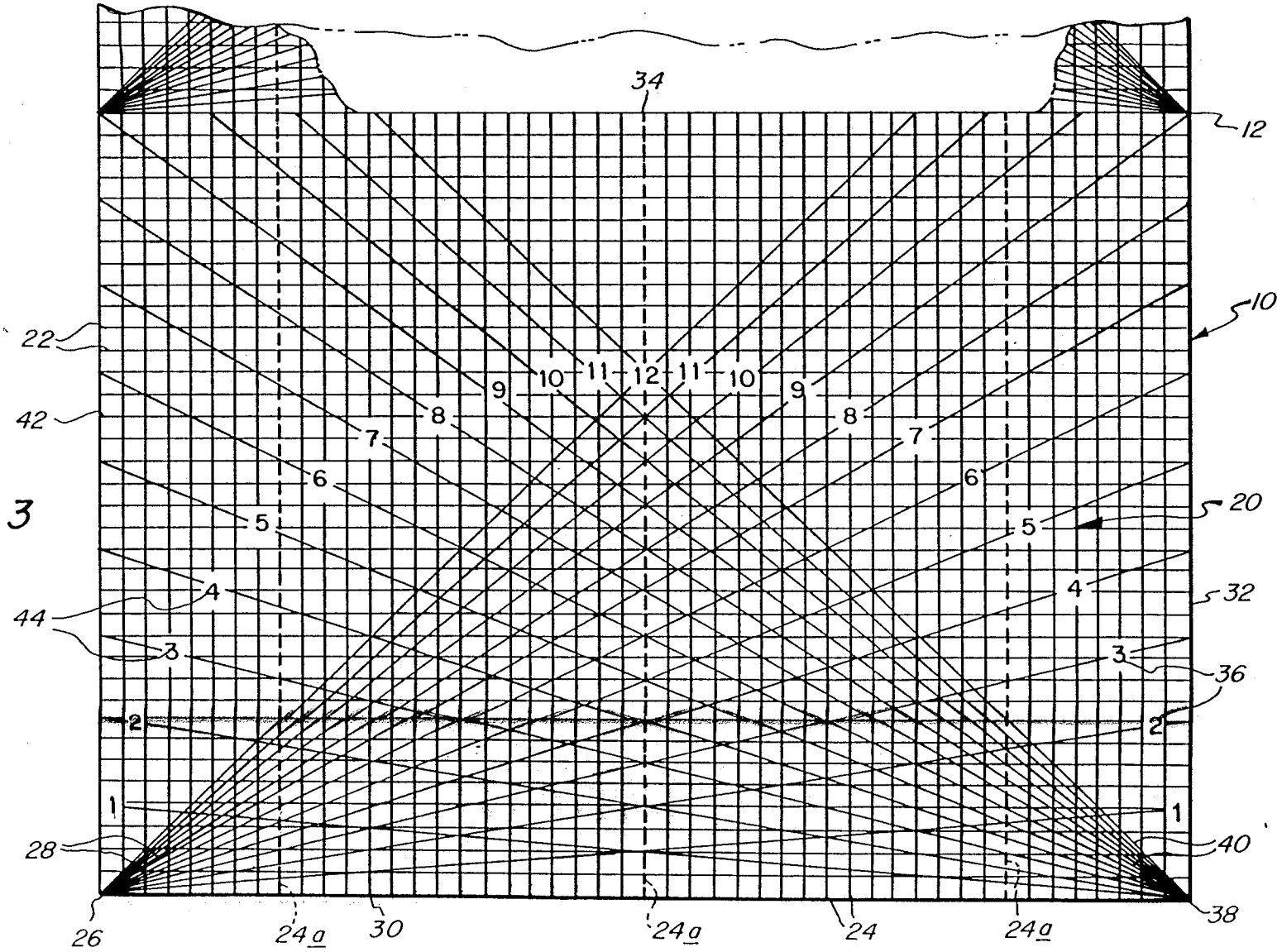
FIG. 3 is a fragmentary plan view of a portion of the length insulating board of FIG. 1 and drawn to an enlarged scale.

As generally seen in FIG. 1 and as seen in detail in FIG. 3, imprinted upon the facing sheet member 16 is a grid pattern generally designated by the numeral 20, and comprised of regularly spaced, perpendicularly intersecting lines 22, 24 extending between opposite sides of the panel 10.

Radiating from one corner 26 is a first multiplicity of lines 28 which extend at increasing included angles relative to the base side 30 and terminating at the far and top side edges 32, 34. Imprinted upon the facing sheet member 16 adjacent the lines 28 is a series of numeric indicia 36.

Radiating from the corner 38 is a second multiplicity of lines 40 of similarly increasing included angles which intersect the lines 28 and which extend to the top and far side edges 34, 42. This second multiplicity of lines 40 also has indicia 44 adjacent thereto.

Also shown on the grid pattern 20 are several lines **24*a* which are printed in a manner to set them off from the other lines 24** and which conveniently represent desired intervals to allow expeditious cutting to desired dimensions or nailing to studs, as will be described more fully hereinafter.

Figure 4:
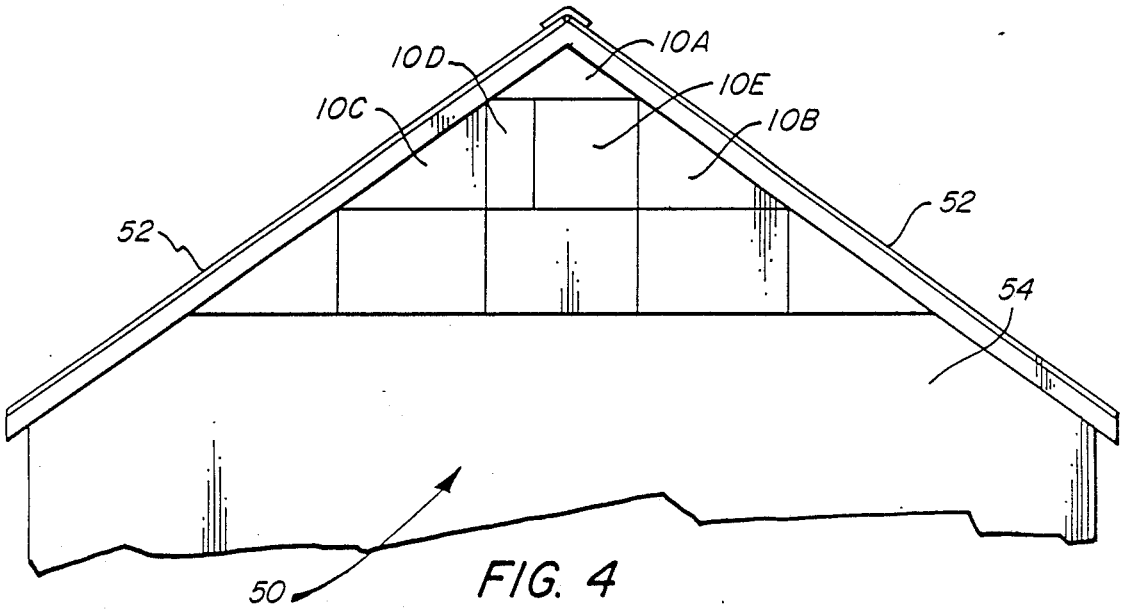
FIG. 4 is a fragmentary, partially schematic view of a portion of the face of a building under the roof showing several panels of the present invention mounted thereon.

Turning now to FIG. 4, therein illustrated is a portion of a house generally designated by the numeral 50 which has roof overhangs 52 overlying the end wall 54 which is to be insulated on its exterior with the panels 10. Also shown are several panels 10A-10F as cut and mounted thereon to insulate a portion of the face 54.

Figure 5A:
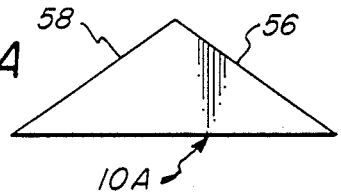
FIGS. 5*a*, 6*a* and 7*a* diagrammatically illustrate panels of present invention after cutting along the cut lines seen in the corresponding FIGS. 5, 6 and 7.
Figure 5:
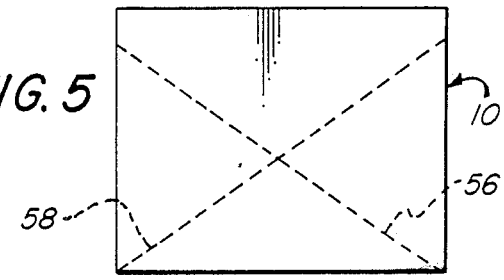
FIGS. 5, 6 and 7 diagrammatically illustrate panels of the present invention showing intended "cut" lines along the imprinted pattern to fit those panels on the face under the roof.

In FIG. 5, a panel 10 is to be cut along the angled lines 56, 58, both corresponding to a roof pitch of 8 inches per foot (indicated by the indicia 36, 44 on FIG. 3). The cut panel is seen in FIG. **5*a* and will fit under the peak of the roof with its cut edges 56, 58 abutting the roof overhangs 52**.

Figure 6A:
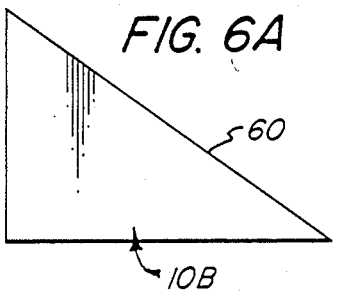
Figure 6:
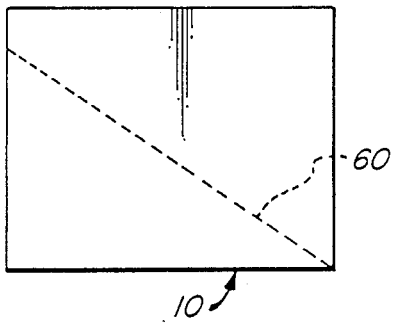

In FIG. 6, the panel 10 is to be cut along the angled line 60 corresponding to the same roof pitch, and the cut panel 10B is seen in FIG. **6*a*. A mirror image is produced on another panel 10 to provide the panel 10C**.

Figure 7A:
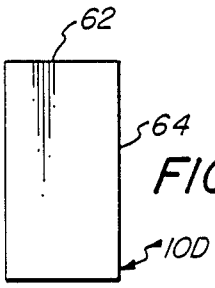
Figure 7:
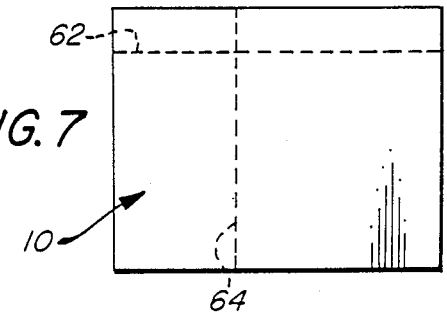

Because the panels 10B and 10C are not full height, the panel 10 seen in FIG. 7 is to be cut along a horizontal grid line 62 corresponding to the height of the panels 10B and 10C. To allow the panel 10E to be a full width (although cut horizontally to the same height as panels 10C and 10D), the panel 10D is also cut along the vertical grid line 64. In this fashion, the several panels 10B, 10C, 10D and 10E traverse the full width of the face 54.

This procedure of cutting panels 10 to match the pitch of the roof 52 is followed, and panels to be disposed therebetween are cut to the same height until the face 52 is fully covered. As in the case of the panel 10D, one of the panels in each row may also be cut to reduce its width as necessary.

Figure 8:
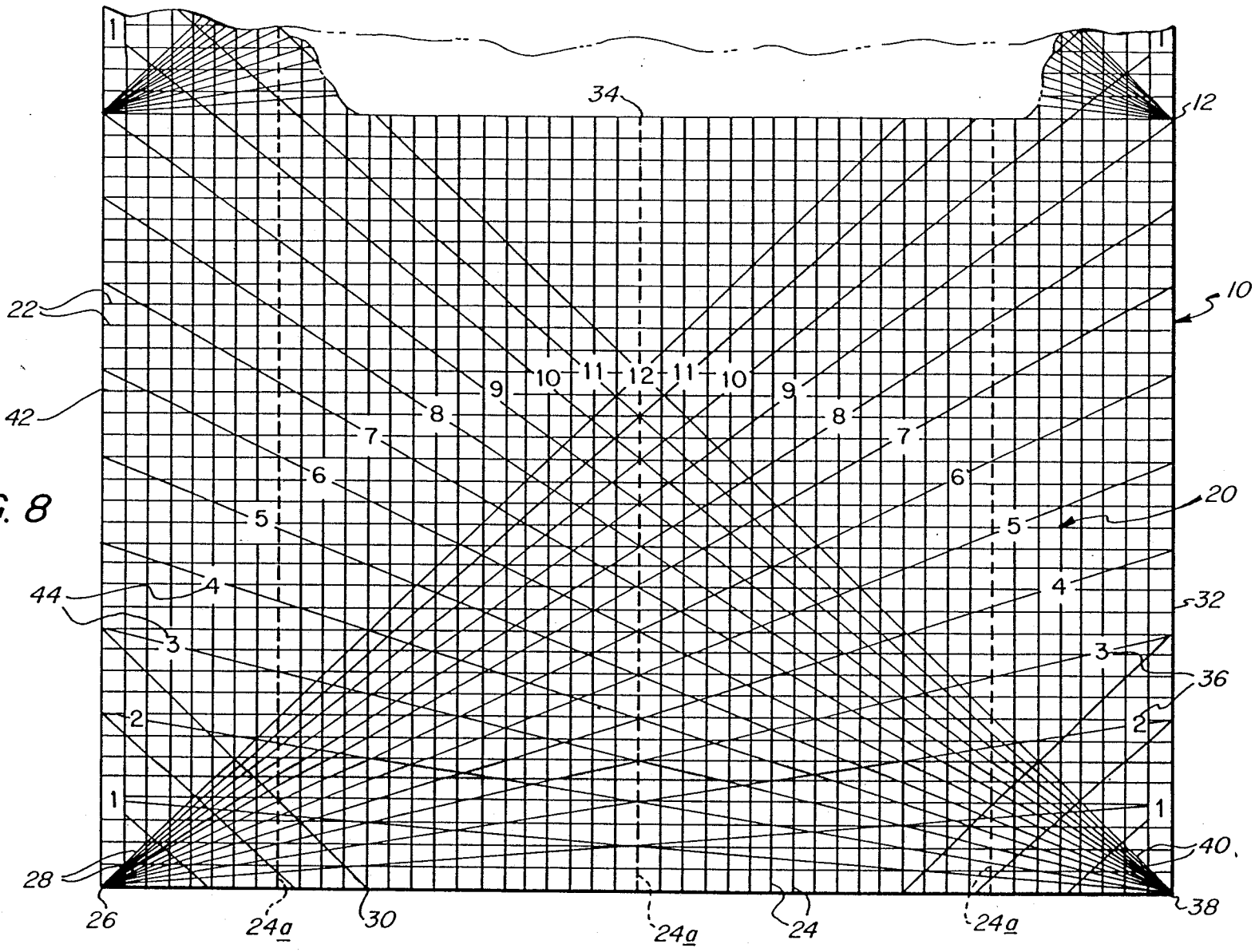
FIG. 8 is a view similar to FIG. 3 of another printing embodiment in which several of the rectilinear lines continue across the top margin of one panel and into the panel thereabove.

In FIG. 8, an alternate embodiment of printing is shown wherein the several lines 28, 38 extending to the top side edge 34 extend into the printed pattern of the panel thereabove to facilitate the cutting of a longer diagonal.

Although the preferred insulating panels utilize core members with facing sheet members bonded to both faces thereof, the imprinting can be effected directly upon a synthetic resin insulating member by screen printing, gravure printing, or the like. Moreover, the core member may have only one facing sheet member thereon.

Conveniently, the grid lines are imprinted at one inch intervals so as to facilitate making horizontal and vertical cuts to fit the panels within the available space. To facilitate rapid determination of vertical cut lines and to facilitate nailing the panels to studs, the vertical lines of the grid pattern may include several lines **24*a* which are of distinct appearance and which represent readily identifiable distances from one or the other of the edges. In the grid pattern seen in FIG. 3, the outer dotted lines 24*a* are spaced inwardly eight inches from the corresponding side edges and the middle line 24*a* is in the center of the panel, thus providing 16 inch spacing between it and either one of the two outer lines 24*a***, and 24 inch spacing from either side edge. This will facilitate placement and nailing to studs on 16 and 24 inch centers. Similarly differentiated horizontal lines may be provided in the grid if so desired.

Typically, the insulating panels will utilize dimensions of three feet high by four feet wide as illustrated for a fan-folded assembly. Other conventional dimensions are eight feet high by four feet wide, four feet high by four feet wide, two feet high by eight feet wide, and two feet high by two feet wide.

For convenience, a multiplicity of panels may be provided in fan-folded units which are unfolded from a vertical stack. This fan-folding may be accomplished by utilizing a strip of material providing the facing member as the hinging mechanism between the panels. In such a fan-folded assembly, the rectilinear lines which extend to the upper edge of a first panel may be continued into the face of the panel thereabove to allow cutting of two panels to form a pair of cut panels conforming to the pitch of the roof.

The core members of the panels will generally be ¼ to 2 inches thick to provide the desired insulating characteristics. Although impregnated wood fiber and cardboard may be used, closed cell synthetic resin foam is normally utilized. Synthetic resin core members are conventionally of expanded polystyrene and polyurethane although other resins such as phenolics may be utilized to provide the desired insulating characteristics. As is well known in the art, such materials may be readily cut with a knife or the like tool to fit a desired location.

The smooth faces for the panel may be provided by the material of the core members if so desired, particularly by the process of extruding the foam resin and densifying the surface as the foam exits the extruder die.

Separate facing sheet members may be metallic foil, paper, synthetic resin film, or combinations thereof. As is also well known in the art, such facing sheet materials may be readily cut with a knife or the like tool. When the panels are to be used on the exterior surface of the building, then both facing members should be vapor permeable. To provide such permeability when utilizing metal foil or plastic film, or combinations thereof, perforations will normally be provided in the facing members at regular intervals to permit passage of air and vapors therethrough. The vapor barrier side of a panel is disposed on the warm side of the structure, i.e., on the interior in northern latitudes and on the exterior in warmer latitudes.

The facing members are imprinted with the grid and pitch lines of the present invention by screen printing, flexographic printing, gravure printing, or any other conventional technique. The imprinting may be repeated upon any elongate length of appropriate material, particularly if fan-folded panels are to be provided. The separate facing members are adhered to the core member conventionally by adhesive although sonic welding or other techniques may be employed where the facing member is of synthetic resin in whole or in part.

The angle lines representing the pitch of the roof are identified by the appropriate pitch identification which is normally expressed in inches of rise per foot of run. Thus, in the illustrated embodiment of FIG. 3, pitches of 1 to 12 inches rise per foot of run are noted. The panel may be turned 90° to use the pitch lines for included angles of 45° to 90°. Although only one set of angle lines may be employed when the facing sheet members on both surfaces are fabricated from the same material since the panel can be cut and then reversed for mounting, it is generally preferable to provide the pitch lines radiating in both directions from opposite corners of the base line of each panel. Moreover, both facing sheet members ma be imprinted with the patterns, particularly when both facing members are fabricated from the same material.

It will be appreciated that the grid lines may also be used for measurement and cutting the panels to fit around doors, windows and outlets.

Thus, it can be seen from the foregoing detailed description and attached drawings that the insulating panels of the present invention provide a simple and effective means for cutting insulating panels along predetermined lines to match pitch of roofs or other angular surfaces and also to fit within other spaces for which measurements have been determined. These panels eliminate the requirement for laying out the measurements upon the panels themselves. A known pitch line or other dimensional characteristics may be readily translated into cut lines upon the panels to facilitate the insulating operation.

Having thus described the invention, what is claimed is:

1. A building panel adapted to be cut to fit closely within a selected area of a building surface comprising an insulating member of generally rectangular configuration having a pair of essentially planar faces, said insulating member being formed from an insulating material providing insulating characteristics and readily cut, said insulating material being selected from the group consisting of wood fiber, cardboard and foamed synthetic resin, one face of said insulating member having printed thereon a grid pattern and a multiplicity of rectilinear lines extending from one corner of said panel at different angular relationships to one of the two sides thereof which intersect at said one corner, said rectilinear lines extending to the remaining sides of said panel, said panel being readily cut along any one of said rectilinear lines or of the lines of said grid for fitting of said panel to conform closely to the periphery of a selected area on a building surface.

2. The building panel in accordance with claim 1 wherein said one face of said insulating member is imprinted with a second multiplicity of rectilinear lines extending from a second corner of said panel and at different angular relationships, said second multiplicity of lines extending to the opposite sides of said panel and intersecting said first mentioned multiplicity of lines.

3. The building panel in accordance with claim 1 wherein said one face of said insulating member has indicia imprinted thereon adjacent said rectilinear lines extending from said one corner.

4. The building panel in accordance with claim 1 wherein both of said faces are imprinted with said grid pattern and multiplicity of lines.

5. The building panel in accordance with claim 1 wherein said insulating member includes a core member of synthetic resin and a facing sheet member secured thereto to provide said imprinted one face, said facing sheet member being selected from the group consisting of metallic foil, paper and synthetic resin film and readily cut.

6. The building panel in accordance with claim 5 wherein said insulating member includes a second facing sheet member secured to the other face thereof, said facing sheet member being readily cut.

7. The building panel in accordance with claim 6 wherein at least one of said facing sheet members is metallic foil adhesively bonded to said core member.

8. The building panel in accordance with claim 3 wherein said indicia are numerical indicia adjacent lines corresponding to the pitch of a roof line represented by said indicia.

9. The building panel in accordance with claim 1 wherein said grid pattern is comprised of lines spaced apart at one inch intervals.

10. A building panel adapted to be cut to fit closely within a selected area of a building surface comprising an insulating member of generally rectangular configuration having a pair of essentially planar faces, said insulating member being formed from a synthetic resin providing insulating characteristics and readily cut, said insulating material being selected from the group consisting of wood fiber, cardboard and foamed synthetic resin, one face of said core member having printed thereon (i) a grid pattern comprised of perpendicularly intersecting lines spaced apart at uniform intervals, (ii) a first multiplicity of rectilinear lines extending from one corner of said panel at different angular relationships to one of the two sides thereof intersecting at said one corner, (iii) a second multiplicity of rectilinear lines extending from a second corner of said panel at different angular relationships, said rectilinear lines extending from said corners to opposite sides of said panel and the lines of said second multiplicity intersecting said first mentioned multiplicity of lines, and (iv) indicia imprinted thereon adjacent lines of each of said multiplicity of lines, said panel being readily cut along any one of said rectilinear lines or of the lines of said grid for fitting of said panel to conform closely to the periphery of a selected area on a building surface.

11. The building panel in accordance with claim 10 wherein said indicia are numerical indicia adjacent lines corresponding to the pitch of a roof line represented by said indicia.

12. The building panel in accordance with claim 10 wherein said insulating member includes an insulating core member of closed cell construction and a first facing sheet member secured to said one face and having said imprinting thereon, said facing sheet member being selected from the group consisting of metallic foil, paper and synthetic resin film and readily cut.

13. The building panel in accordance with claim 10 wherein at least a second facing sheet member is secured to the other face of said core member and one of said facing sheet members is metallic foil adhesively bonded to said core member, said facing sheet member being readily cut.

14. In a method for insulating buildings and the like, the steps comprising:

(a) providing one face of a insulating member with an imprinted grid pattern and a multiplicity of rectilinear lines extending from one corner thereof at different angular relationships to one of the sides thereof, said lines extending to opposite sides of said facing member and corresponding to the pitches of roofs, said imprinted insulating member providing an insulating panel;

(b) determining the pitch of an inclined structural element;

(c) locating on said printed face of said panel the one of said multiplicity of lines corresponding to said pitch;

(d) cutting said insulating panel along said located line; and (e) mounting said cut panel on the face of a building with said cut line abutting such structural element.

15. The method of insulating buildings in accordance with claim 14 including the additional steps of measuring the space transversely of a wall upon which said panel is to be mounted; determining the width desired for said panel in said space; locating the vertical grid line corresponding to said desired width; and cutting said panel along said vertical grid line.

16. The method of insulating buildings in accordance with claim 14 in which said one face is also imprinted adjacent said lines with indicia which correspond to the pitch of roof lines represented thereby.

17. The method of insulating buildings in accordance with claim 14 wherein said one face is also imprinted with a second multiplicity of rectilinear lines extending from a second corner of said panel and at different angular relationships, said second multiplicity of lines extending to the opposite sides of said panel and intersecting said first mentioned multiplicity of lines.

18. The method in accordance with claim 14 wherein said panel is formed by imprinting a first facing sheet member with said pattern and lines and securing said sheet member to one face of a synthetic resin core member.

19. The method in accordance with claim 18 wherein a second facing sheet member is secured to the other face of said core member.

* * * * *